US005341649A

United States Patent [19]

Nevitt et al.

[11] Patent Number: 5,341,649

[45] Date of Patent: Aug. 30, 1994

[54] HEAT TRANSFER SYSTEM METHOD AND APPARATUS

[75] Inventors: James N. Nevitt, Cape Coral; Laurel R. Chapman, North Ft. Myers, both of Fla.

[73] Assignee: Future Controls, Inc., Ft. Myers, Fla.

[21] Appl. No.: 27,237

[22] Filed: Mar. 5, 1993

[51] Int. Cl.[5] ..... F25B 41/00

[52] U.S. Cl. ..... 62/126; 62/127; 62/129; 62/184; 62/DIG. 2

[58] Field of Search ..... 62/181, 183, 184, 507, 62/125, 126, 127, 129, DIG. 2, DIG. 17

[56] References Cited

U.S. PATENT DOCUMENTS

| | | | |
|---|---|---|---|
| 2,949,750 | 8/1960 | Kramer | 62/DIG. 2 |
| 3,081,606 | 3/1963 | Brose et al. | 62/DIG. 2 |
| 3,412,570 | 11/1968 | Pruett, Sr. | 62/129 |
| 4,328,682 | 5/1982 | Vana | 62/129 X |
| 4,484,818 | 11/1984 | Houston | 356/432 |
| 4,644,755 | 2/1987 | Esslinger et al. | 62/126 |
| 4,661,320 | 4/1987 | Kubo et al. | 422/86 |
| 4,749,856 | 6/1988 | Walker et al. | 250/227 |
| 4,863,694 | 9/1989 | Kimmel et al. | 422/86 |
| 5,072,595 | 12/1991 | Barbier | 62/129 |
| 5,146,767 | 9/1992 | Kadle et al. | 62/507 X |
| 5,230,223 | 7/1993 | Huller et al. | 62/126 X |

OTHER PUBLICATIONS

Union Carbide Europe Catalog, p. EQ57.
Liquid Carbonic Catalog, p. 5.31.
Air Products and Chemicals, Inc. Catalog, p. 60.
MG Industries Catalog.
Liquid Air Corporation—Alpha Gas Catalog, p. 182.

*Primary Examiner*—Harry B. Tanner
*Attorney, Agent, or Firm*—Myron E. Click

[57] ABSTRACT

Method and apparatus for remotely monitoring the condition of a heat transfer fluid in the liquid line of a heat transfer system. The operation of the system is controlled in response to the results of the remote monitoring which may be used to indicate excessive moisture in the heat transfer fluid, low levels of heat transfer fluid, and non-condensed transfer fluid in the liquid line. Based upon the monitoring of the transfer fluid for non-condensed fluid, the rate of movement of a cooling fluid past a condenser for the transfer fluid is varied so that the temperature of the heat transfer fluid is kept as low as possible without formation of bubbles of non-condensed transfer fluid in the liquid line.

25 Claims, 5 Drawing Sheets

154
134
EVAPORATOR
132
130
136
SLI
ALARM 4
ALARM 3
ALARM 2
ALARM 1
152
150
146
HD
158
SGS
HEAD PRESSURE SENSOR
CONTROL CKT.
SIGHT GLASS SENSOR
138
144
140
142
NI
170
CONDENSER
SUBCOOLING
SPEED CONTROL
PUMP CONTROL CKT.
P
156
LLT
148

HEAT TRANSFER SYSTEM METHOD AND APPARATUS

BACKGROUND OF THE INVENTION

1. Field of the Invention

This invention relates to heat transfer systems generally and, in particular, to a method and apparatus for remotely monitoring the condition of a heat transfer fluid in the liquid line of a heat transfer system, and for controlling operation of the system in response to the results of the remote monitoring.

2. Description of the Prior Art

A heat transfer system usually includes a compressor for compressing a gaseous heat transfer fluid (commonly called a refrigerant) as the gas is received from an evaporator. The compressed gas is then condensed to a liquid by a cooling fluid moving past and in heat exchange relationship with a condenser. The liquid travels through a liquid line to an expansion valve, which converts the high pressure liquid to a low pressure liquid and gas mixture. The mixture travels through the evaporator where most of the liquid turns to a gas in the process of absorbing heat, and then through a suction line to the compressor where the cycle is repeated.

The purpose of the compressor is to raise the pressure of the refrigerant gas from evaporator pressure to condensing pressure. During compression a considerable amount of heat is added to the gas being compressed, causing the gas to be superheated. This heat must be removed and the refrigerant gas condensed to a liquid ready for use by the expansion valve and evaporator.

The capacity of a condenser to remove heat is affected by the temperature and quantity of the cooling fluid passing in heat exchange relationship with the condenser, and the temperature of the refrigerant gas. The capacity of the condenser will increase whenever the temperature difference between the refrigerant gas and the cooling fluid is increased. This temperature difference may be increased by raising the condensing pressure, by lowering the temperature of the cooling fluid, or by increasing the quantity of cooling fluid passed by the condenser in order to maintain a lower average cooling fluid temperature.

Before condensation can begin, the superheated gas must be cooled to the saturation temperature. After reaching saturation temperature further removal of heat will cause the gas to condense. All superheat and latent heat removed from the refrigerant in the condenser is taken away by the condenser cooling fluid. It is generally desirable to remove further heat by cooling the condensed refrigerant liquid to a lower temperature than indicated by the condensing pressure. This additional cooling of the liquid is called subcooling.

The refrigeration effect is the difference in heat content between the liquid at the temperature it leaves the condenser and the heat content of the vapor entering the compressor, and subcooling can enlarge this difference. This can be calculated for each case, but a generalization can be made for air conditioning applications that for each degree of subcooling the system capacity is increased about 0.5 percent, when the subcooling is not from within the refrigeration cycle itself. This increase is the result of the increased refrigerating effect per pound of refrigerant flow.

Subcooling may be accompanied in the condenser, in a subcooler external to the condenser, or in a liquid line/suction line heat exchanger. The liquid/suction heat exchange subcooling may be used to prevent the formation of bubbles of non-condensed refrigerant in the liquid line to obtain maximum, expansion valve capacity. However, this subcooling effect is obtained from within the refrigeration cycle and doesn't directly increase the refrigerating effect per pound of refrigerant flow.

Therefore, it is preferable to obtain subcooling by removing further heat by cooling the condensed liquid in the condenser itself and/or in a subcooler external to the condenser. This is preferably obtained by moving a cooling fluid past and in heat exchange relationship with the condenser and/or the external subcooler.

Subcooling also allows the system designer more latitude in handling liquid risers and even high liquid line pressure drops if the other limitations in sizing piping are observed. However, subcooling can also create some problems, as will be noted later.

In addition to subcooling to obtain an increase in refrigerating effect, it is also desirable to operate the system so that the head pressure is as low as possible to enable more economical compressor operation. This can be accomplished by lowering the temperature of the refrigerant in the liquid line before the expansion valve to the lowest temperature permissible to obtain the lowest head pressure (condenser temperature). Increasing the cooling effect in the condenser by controlling movement of cooling fluid in heat exchange relationship with the condenser and/or subcooling unit will lower refrigerant temperature in the liquid line.

Thus, there are parameters which are goals in operating a heat transfer system at its maximum capacity and efficiency while using the least energy or power possible. First, the lower the head pressure (condenser pressure), the lower the horsepower requirement for the compressor. Secondly, maximizing subcooling increases compressor capacity as a result of the increased refrigeration effect per pound of refrigerant flow.

On the other hand there are constraints in attempting to achieve these goals. While a lower condensing temperature requires less compressor horsepower, there is a minimum head pressure/condensing pressure required for satisfactory operation of the expansion valve. In many systems the minimum head/condensing pressure is equivalent to about a 90 degree condensing temperature.

If the pressure drops too low in the liquid line, the refrigerant liquid will boil. Since there is no source of heat except the liquid refrigerant, just enough will boil or flash into vapor to lower the temperature of the body of liquid. This vapor is known as flash gas or bubbles of non-condensed refrigerant. The formation of these bubbles in the liquid line before the expansion valve is undesirable, because the gas displaces some of the liquid passing through the expansion valve. This reduces the expansion valve capacity and thus the system capacity. Causes of the pressure drop in the liquid line include friction as the liquid moves through the lines, static head in risers of the liquid line (where the pressure at the top of a column of refrigerant is lower than the pressure at the bottom of the column in a riser), or when the components get out of balance with the design because various components have capacity increases and decreases during operation.

Further, in applications such as air conditioning and chillers, the compressor will operate at a lower suction pressure or temperature when the evaporator load is reduced. If the load falls low enough the suction temperature may fall below 32 degrees F. before the balance point is reached. Therefore, the final temperature of the air will be undesirably low causing the moisture condensing on the evaporator to freeze, or air-flow-obstructing frost to form. The ice or frost forming on the evaporator coil will restrict the air flow and aggravate the condition by forcing the suction temperature even lower. On a chiller, the barrel may freeze.

The system designer will select the sizes and capacities of the components of the system, including sizing the piping and determining the height of any risers, so that the system will operate as efficiently as possible with the load that the system is carrying most of the time. however, loads do not remain constant and provision must be made for the variations.

For example, if the heat transfer system is being used in an air conditioning application, problems occur because as the outdoor temperature drops, the average air conditioning load also drops. These problems may be compounded by a constant internal load requiring system operation even when the outdoor temperatures fall to or below freezing. It is helpful to reduce the condenser capacity so that overall system capacity is reduced as outdoor temperature and the load drops.

Various approaches to cure these problems have been mostly directed to controlling operation of individual components. For example, if condenser capacity needs reducing multiple speed condenser fans have been used which are responsive to liquid line temperatures. Multilouvered dampers have also been used to control air flow past condenser coils because this is less expensive than variable speed for motors. Shutters Or dampers are controlled in response to liquid line pressure, which is approximately equal to head pressure.

Other controls include cycling the condenser fans "off" and "on" in response to reaching a minimum head pressure. The system continues to operate, but the efficiency goes down. Some of the fan cycling systems do not have dividers between the multiple fans. This allows air to be pulled backward and the fans that are operating lose their effectiveness. In low ambients, the fans are turned "on" and "off" very rapidly. Some controls flood the condenser with refrigerant to reduce the effective condenser area. These systems require large amounts of refrigerant for their tonnage sizes.

The prior art controls approach operational problems by trying to control individual components or problems, many times at the expense of increased power consumption and/or reduced system efficiency. Therefore, it is proposed to control the system holistically, that is to approach the system control by coordinating the functional relationship of all of the components.

Accordingly, it is an object of this invention to provide an improved heat transfer system.

It is a further object of this invention to provide an improved control system for heat transfer apparatus.

A still further object of this invention is to provide a control system and a method that operates heat transfer apparatus at its maximum efficiency by reducing head pressure and increasing subcooling without allowing non-condensed gas to exist for any extended period of time in the liquid line of the system.

Another object of this invention is to provide an improved method and device for monitoring the condition of a heat transfer fluid in the liquid line.

It is also an object of this invention to provide an improved method for operating a heat transfer system and for monitoring the condition of a heat transfer fluid in the liquid line.

Other objects, advantages and features of this invention will become apparent when the following description is taken in conjunction with the accompanying drawings.

SUMMARY OF THE INVENTION

Apparatus is disclosed for remotely monitoring the condition of a fluid stream in a conduit which includes a radiation source and a means for detecting radiation. Means are provided for positioning the radiation source so that radiation therefrom impinges the fluid stream in the conduit. Means are also provided for positioning the radiation detector to detect radiation after it impinges the fluid stream. Means responsive to the radiation detector generates a signal proportional to the amount of radiation detected to indicate the condition of the fluid stream being monitored.

The fluid steam may be a heat transfer fluid in a liquid line between a fluid condenser and a fluid evaporator. The radiation source may be a light source such as a light emitting semiconductor. The radiation detector may be a photosensitive device such as a photocell.

One condition being monitored is the formation of bubbles of non-condensed fluid in the fluid stream. Accordingly, the radiation source is positioned to direct radiation at the fluid stream so that when bubbles form, the amount of radiation detected is altered. Another condition being monitored is the moisture content of the stream. Therefore, an indicating element, adapted to change color when the moisture content changes, is positioned in the stream. The amount of radiation detected is altered in response to a change in color of the indicating element. In the embodiments disclosed herein a sight glass having window means for passing the radiation to and from the fluid stream is used.

Fan, pump or other means may be used to move air, water or other cooling fluid past and in heat exchange relationship with the condenser to remove heat from the heat transfer fluid. Speed control or other means may be used for the fan or pump to vary the rate at which those cooling fluid moving means move the cooling fluid past the condenser. The speed control or other means is responsive to the amount of radiation detected to vary that rate to maintain heat exchange fluid in a liquid line at the lowest temperature possible without formation of non-condensed fluid in the liquid line. The rate is decreased in response to an increase in flash in the liquid line, and increased in response to a decrease in flash in the liquid line.

The apparatus further includes means for sensing the temperature of the heat exchange fluid in the liquid line and providing a signal when the fluid exceeds a predetermined temperature. Means responsive to a sensed excessive temperature terminates the operation of the cooling fluid rate varying means, and sets that fluid movement at a predetermined rate. Similarly, the temperature in the suction line is sensed, and operation of the cooling fluid rate varying means is terminated when the temperature goes below a predetermined set point, and the fluid movement is set at predetermined rate. Further, the head pressure is sensed prior to entry of the fluid into the condenser, and operation of the cooling fluid rate varying means is terminated when the pressure goes above a predetermined set point, and the fluid movement is set at a predetermined rate.

A fluid pump may be disposed in the liquid line. Control means for the liquid pump may start the pump in response to the detection of a predetermined amount of bubble formation in the liquid line, and stop the pump when bubble formation falls below that predetermined amount. The invention further includes a method for operating and controlling a heat transfer system by monitoring the condition of a heat transfer fluid in a liquid line between the condenser and evaporator. This includes positioning a radiation source so that radiation therefrom impinges the heat transfer fluid in a liquid line, positioning a radiation detector to detect radiation after impingement with the transfer fluid, and measuring the amount of radiation detected to determine the condition of the fluid.

A further step includes locating an indicating element in the transfer fluid which changes color in response to a change in moisture content in the transfer fluid. The radiation detected is altered in response to color changes of the indicating element.

Further, formation of bubbles of non-condensed transfer fluid alters the amount of radiation received by the radiation detector. The step of generating a detection signal which is proportional to the amount of radiation detected will provide a signal for controlling the operation of the heat transfer system.

Further steps include moving a cooling fluid past and in heat exchange relationship with the condenser. The rate of movement of the cooling fluid is varied in response to the radiation detection signal so that the temperature of the transfer fluid in the liquid line is kept as low as possible without formation of bubbles of non-condensed transfer fluid in the liquid line. The pressure of the transfer fluid in the liquid line may be increased by starting a liquid pump in the liquid line in response to a predetermined amount of radiation detected by the radiation detector.

BRIEF DESCRIPTION OF THE DRAWINGS

In the drawings, where like numerals are employed to designate like parts throughout.

DESCRIPTION OF THE PREFERRED EMBODIMENTS

Figure 1:
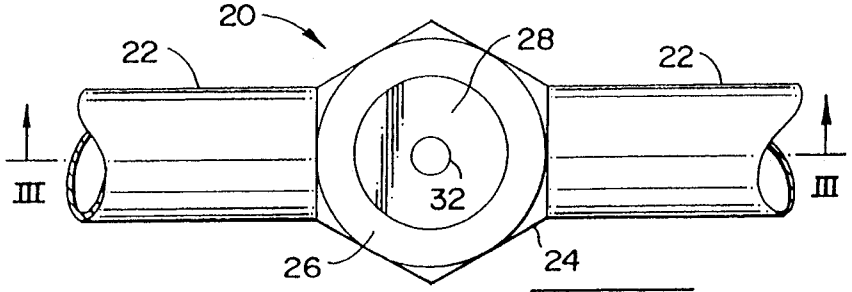
FIGS. 1 and 2 are plan and side views of a sight glass device that has been used in the past to allow direct visual observation of the condition of a refrigerant stream.
Figure 3:
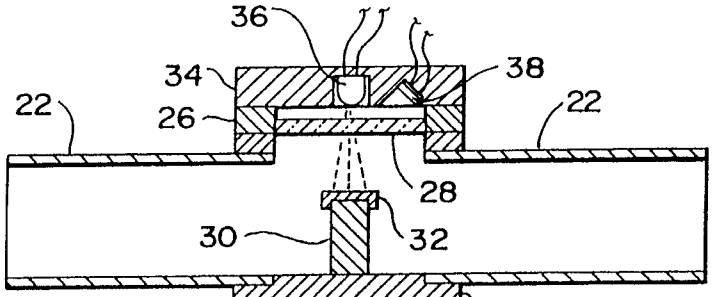
FIG. 3 is a cross-sectional view of a sight glass sensor useful in this invention, taken along lines III—III of FIG. 1.
Figure 2:
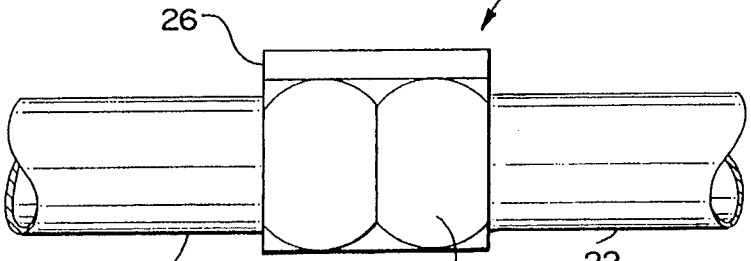

Referring now to FIGS. 1 through 3 there is illustrated a sight glass device that may be used in this invention. A sight glass device is installed in the liquid line of a refrigerant circulation loop to permit direct visual inspection of the liquid refrigerant. Initially, such devices were used to allow an operator to physically observe bubbles of non-condensed refrigerant, which indicate a low level of refrigerant in the system, or a restriction in the liquid line such as a plugged drier. Subsequently, an indicator element was added for direct observation, which changes color in response to a change in the moisture content in the refrigerant. Such devices are commercially available from the Sporlan Valve Company in St. Louis, Mo.

FIG. 1 is a plan view and FIG. 2 is a side view of a sight glass. FIG. 3 is a sectional view taken along lines III—III in FIG. 1, specifically showing means for remotely monitoring the condition of the refrigerant in the liquid line between the condenser/subcooler and the expansion valve of a refrigerant circulating loop.

A sight glass device generally indicated at 20 is installed in a liquid line 22 (or a bypass thereof), so that refrigerant passes through the body 24 of the sight glass 20. A support 26 holds a transparent observation window or lens 28 which enables physical observation of the refrigerant within the liquid line 22.

The sight glass shown is known as a single lens or window type. However, it is intended to be representative of and a disclosure of the double lens or window type which has a second viewing window or lens mounted on the sight glass body opposite to the single lens location in FIGS. 1 through 3. The double sight glass is normally recommended when the sight glass is located in a dark place, because a light may be used behind one of the windows enabling an observer to better see the condition of the refrigerant. The double sight glass may be used for a different purpose in this invention, as will be described in detail hereinafter.

Referring now to FIG. 3, an indicator element support 30 is positioned in the body 24 to locate a moisture sensitive indicator element 32 where it can be seen through window 28. In the Sporlan Valve Company model, the indicator element is dark green when the moisture content of the refrigerant is in the acceptable or "dry" range. As the moisture content increases, the indicator element 32 changes to a chartreuse color when the moisture content is in the middle range, indicating that the moisture level is approaching an unacceptable or "caution" level. As the moisture increases further, the element 32 changes to a yellow color indicating an unacceptable or "wet" level. The color change is reversible and will change to the appropriate color as the moisture content changes. The drier should be changed when the moisture content moves through the caution to the wet range. When used in the normal "direct observation" mode, an operator or technician can see the color changes as they occur.

All of the just-discussed conditions of the refrigerant in the liquid line have required direct physical observation by an operator present at the sight glass in order for the operator to be aware of those conditions. Many times the sight glass is in a position that is difficult to get to and to see. Moreover, an operator may be responsible for the operation of multiple systems, sometimes spaced so far apart that timely observations are impossible. Therefore, it would be very important for an operator to be able to monitor those conditions remotely. Further, if such conditions could be remotely monitored and a signal generated which is indicative of the conditions, then automatic controls could be implemented which are responsive to such signals.

Figure 4:
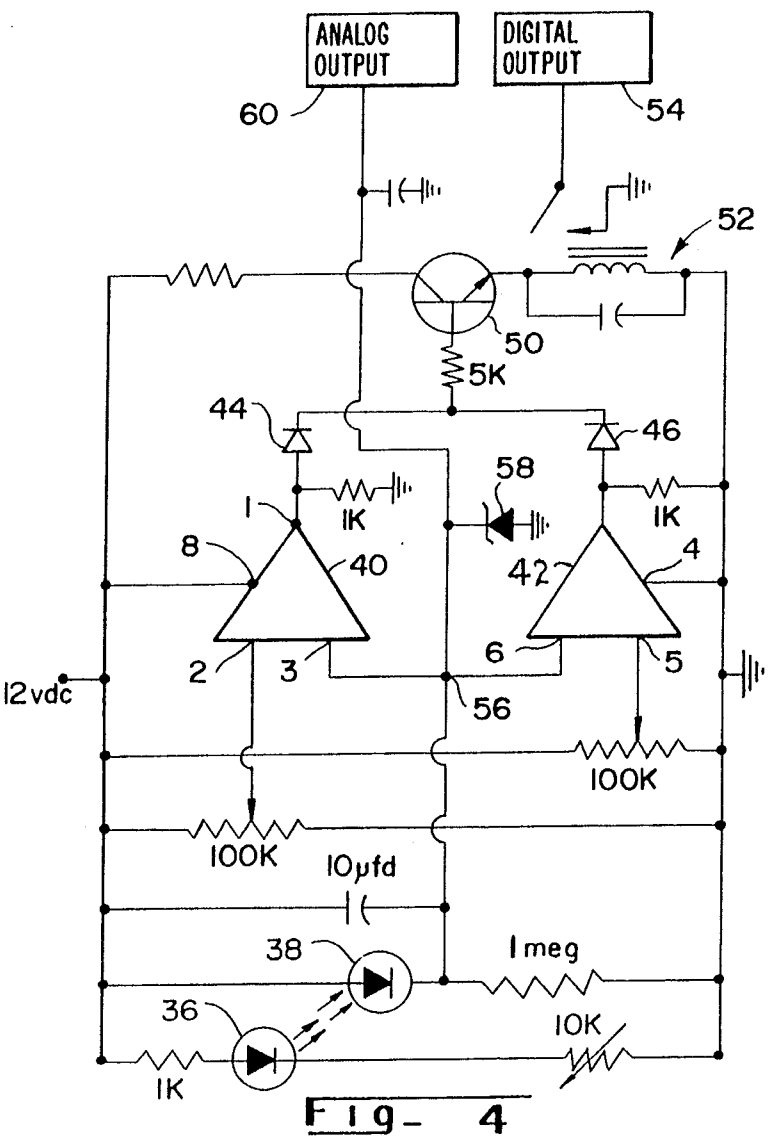
FIG. 4 is a schematic diagram of a circuit for use with the sight glass of FIG. 3 to remotely monitor the condition of a refrigerant stream.

A first embodiment of such remote monitoring is illustrated in FIGS. 3 and 4. In FIG. 3, a cap 34 is secured to the sight glass 20 to support a radiation source 36 and a radiation detection device 38. The cap is preferably formed from an opaque material that will block entry of radiation from the exterior into the interior of the sight glass 20. The radiation source 36 is positioned to emit radiation which will impinge or contact the refrigerant in the sight glass 20, and, if used, the indicator element 32. The radiation is reflected from the surface of the refrigerant and/or the surface of the indicating element 32. The reflected radiation is detected by the detection device 38.

The formation of bubbles of non-condensed refrigerant in the liquid line 22 will reduce the amount of reflected radiation available for detection by device 38, usually on a directly proportional basis. That is, the amount of reflected radiation is proportional to the amount of bubble formation.

If one wished to use the monitor of this invention to detect only bubble formation, one could use a double sight glass, and locate the radiation source 36 to emit radiation through the first window, through the refrigerant, and out the second window to a detection device 38. In this instance, the emitted radiation would still impinge the refrigerant, but the detection device would receive radiation transmitted through the refrigerant, rather than radiation reflected from the refrigerant. In either case, the formation of bubbles in non-condensed refrigerant reduces the amount of radiation received by the detection device 38, and will be a measure of that condition of the refrigerant.

With respect to the indicator element 32, the color of the element will determine how much radiation is reflected to the detection device 38. In the case of the Sporlan Valve Company indicator element, the dark green color will reflect very little radiation, while the chartreuse color will reflect more radiation and the yellow color will reflect still more radiation. Therefore, the amount of reflected radiation detected will be a measure of the condition of the refrigerant, in this instance the moisture content.

The radiation source 36 preferably used in the embodiment in FIG. 3 is a light emitting diode, while the radiation detector 38 is preferably a photosensitive semiconductor such as a photocell. Radiation is defined as energy emitted in the form of electromagnetic waves. These include, in order of increasing wave length; cosmic rays, gamma rays, x-rays, ultra-violet radiation, light, infra-red radiation, heat rays and radio waves. For use in this invention, the first three would not be used based upon problems involving practical control of the radiation and their tendency to penetrate rather than be reflected or deflected. The remainder of the list are susceptible to deflection and reflection because of bubble formation and reflectable in varying amounts depending upon the conditions of the reflecting surface (e.g. color), and the reflected or deflected radiation is detectable in a manner which enables production of a signal proportional to the amount of reflected waves which are detected. The prime factors in selecting a particular radiation source from the latter group are expense, reliability and the ability to mass produce this part of the control with a maximum opportunity to obtain identical operation of the components in actual installations. Thus, light radiation is the preferred choice even though similar results could be obtained from other sources.

FIG. 4 is a schematic diagram of a circuit which uses an output from the radiation source 36 and a radiation detector 38 combination to remotely indicate the condition of the refrigerant in liquid line 22. The light emitting diode 35 may have a radiation of red or green light for proper reflection from either the refrigerant or the Sporlan type indicator element 32.

The photocell 38 detects the light reflected either by the indicator element 32 or the surface of the refrigerant, and changes resistance in proportion to the amount of reflected light detected. The change of resistance causes a change in voltage at the input terminal 56 of a dual operational amplifier 40,42. The reference voltages at pin 2 of amplifier 40 and at pin 5 of amplifier 42 are adjusted to the states as set forth below.

First, if the moisture and refrigerant level in the liquid line are acceptable, the output of the dual amplifier 40, 42 remains in an "off" state. Therefore, the voltage at the base of the output transistor 50 is below that necessary to turn transistor 50 "on".

If the indicator element 32 changes color from an acceptable dark green (dry) to a chartreuse (caution) to yellow (wet), then more and more light will be reflected to the photocell 38. As the photocell receives more reflected light the resistance will drop, allowing more current flow and an increasing voltage across the one meg resistor in series with the photocell. When this voltage rises above the upper threshold set point (established by the reference voltage connected to pin 2 of amplifier 40), then amplifier 40 provides a positive output at pin 1 through diode 44 to the base of output transistor 50. This will turn the transistor 50 "on" to supply current to close relay 52 to provide a digital output at 54. This output can be used to activate visual or audible alarms, or to activate a control function.

If foaming flash or bubbles of non-condensed refrigerant occur, less light is reflected from the surface of the refrigerant to the photocell 38, causing the resistance of the photocell to increase. This reduces the voltage at terminal 56 and at pin 6 of amplifier 42. When this voltage drops below the lower threshold set point (established by the reference voltage connected to pin 5 of amplifier 42), then amplifier 42 provides a positive output voltage at pin 7 through diode 46 to the base of the output transistor 50. This will turn transistor 50 "on" to supply current to close relay 52 to provide a digital output at 54, which may be used to activate alarms or to activate a control function.

An analog output at 60 which is directly proportional to the condition of photocell 38, and to the condition of the refrigerant in liquid line 22, may be obtained from the terminal 56. The magnitude of this output may be limited by connecting a zener diode 58 between terminal 56 and ground. The analog output may be used to control functions that may be proportionally adjusted.

In some instances, it may be desirable to monitor only the formation of bubbles of non-condensed refrigerant or only the moisture content of the refrigerant. The indicator element 32 may be eliminated, along with amplifier 40 and its associated connections and components to monitor only bubble formation. Similarly, if amplifier 42 and its associated connections and components are eliminated, only the moisture content of the refrigerant is monitored. Obviously, both conditions could be monitored at the same time by individual sight glasses, each equipped with a radiation source and a radiation detection device connected to an appropriate circuit as described above for monitoring the desired condition. The sight glass monitoring the moisture content would, of course, need an indicator element 32 with an appropriate support.

Further, both bubbles and moisture may be monitored at the same time with the FIG. 4 circuit, if modified to provide separate outputs to provide a separate bubble indication signal, and to provide a separate moisture indication. To do so, one would simply separate the outputs of amplifiers 40, and 42 and provide each amplifier with its own output transistor and associated relay.

Figure 6:
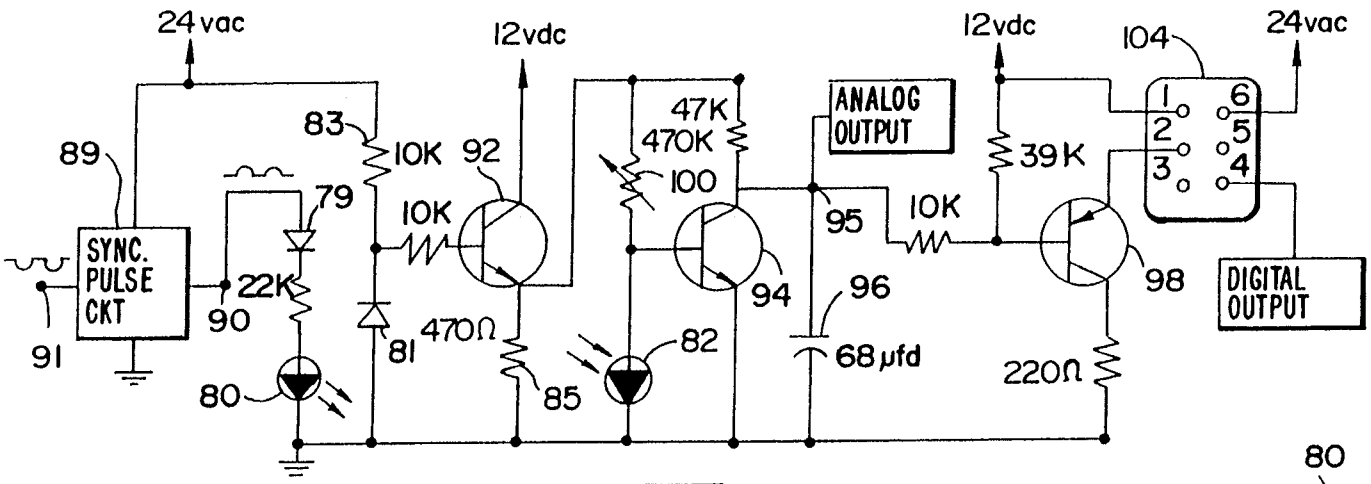
FIGS. 6 and 7 are schematic diagrams of circuits for use with the sight glass sensor of FIG. 5 to remotely monitor the condition of a fluid stream.
Figure 5:
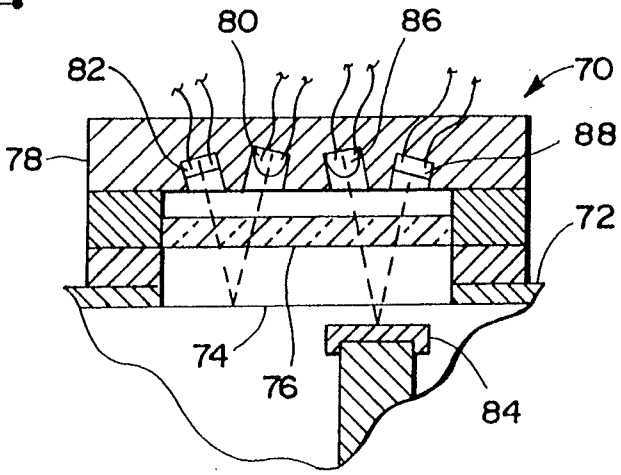
FIG. 5 is a cross-sectional view of a second embodiment of a sight glass sensor.
Figure 7:
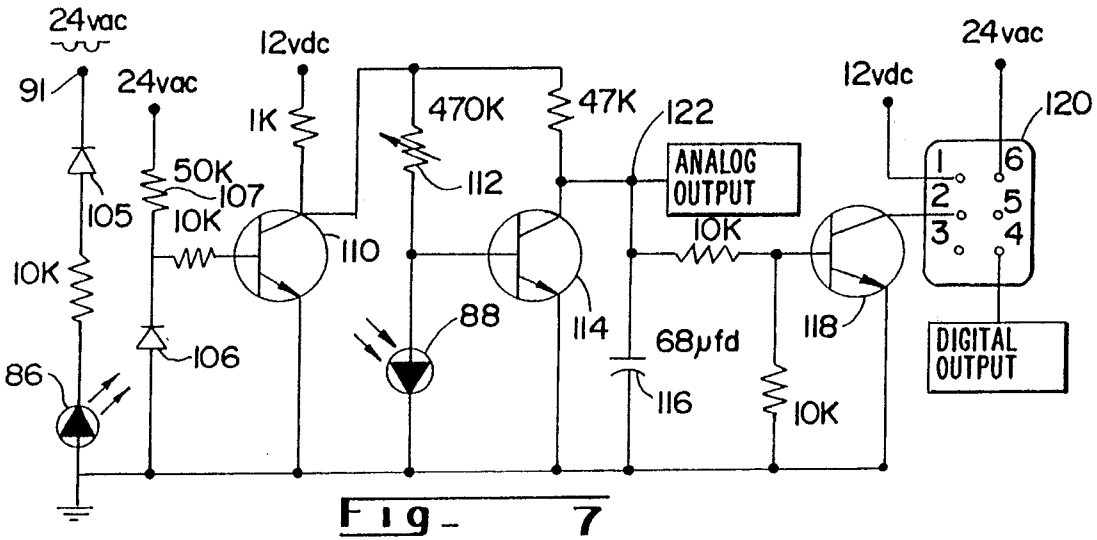

While the embodiment disclosed in FIGS. 1 through 4 can be used to monitor both moisture content and formation of non-condensed refrigerant, it is desirable to have an arrangement in which separate individual signals for each of the conditions are available so that automatic control of the operation of the system can more readily be obtained. such an embodiment is disclosed in FIGS. 5 through 7.

In FIG. 5 a modified sight glass device 70 is shown connected in a liquid line 72 which carries a stream of refrigerant 74. A viewing window 76 is covered by an opaque cap 78. A first light emitting diode 80 is supported and positioned in cap 78 so that light is radiated to and reflected off of the surface of the refrigerant 74.

A first photocell 82 is supported and positioned in cap 78 to detect light reflected from the surface of refrigerant 74.

A moisture indicating element 84 is positioned in stream 74 in sight glass 70 so that light radiated from a second light emitting diode 86 supported in cap 78 strikes indicator element 84. A second photocell 88 is supported and positioned in cap 78 to detect light reflected from element 84 after it is received from diode 86.

Referring now to FIG. 6, there is schematically illustrated a circuit for providing digital and analog signals representative of the condition of the refrigerant stream 74 with respect to bubbles of non-condensed refrigerant (flash) present in sight glass 70. A synchronous pulse circuit 89 provides a source of positive half-wave pulses at terminal 90 for use in the circuit of FIG. 6. A source of negative half-wave pulses is provided at terminal 91 for use in the circuit of FIG. 7, to be described hereinafter.

The synchronous pulse circuit 89 may include two rectifier diodes connected in two parallel branches between a supply (e.g. 24 vac) and ground. A first of the rectifier diodes is connected in series with a first resistor in the first branch, so that when the first diode is forward biased, positive half-wave pulses are developed across the first resistor. The second rectifier diode is connected in series with a second resistor in the second branch so that when the second diode is forward biased negative half-wave pulses are developed across the second resistor. Since the same alternating current supply is used to generate both the positive and negative pulses, only one of each type can appear at any one time and thus are fully synchronized with each other.

During the positive half-cycle of the 24 vac supply at terminal 90, a source diode 79 is forward biased. Current flow is limited by a resistor but the light emitting diode 80 conducts to radiate light toward the surface of the refrigerant stream 74 as shown in FIG. 5.

A pulse shaping circuit includes a transistor 92. The 24 vac source is connected to ground through a steering diode 81, with the base of transistor 92 being connected between the source and the steering diode 81. During the negative half-cycle of the source voltage, diode 81 is forward biased, clamping the base of transistor 92 at a very small voltage to keep the transistor 92 turned "off", and the voltage at the emitter of transistor 92 at zero.

During the positive half-cycle of the 24 vdc source voltage, the steering diode 81 prevents current from flowing through resistor 83, causing the transistor 92 to switch to an "on" state. Current then flows from the 12 vac supply through the collector-emitter circuit of transistor 92 and resistor 85 to ground, generating a voltage across resistor 85. Since the transistor 92 operates in a saturated mode during the "on" state, the resulting wave form output across resistor 85 is a square wave.

The square wave pulses on resistor 85 act as a supply voltage across and controlled by the radiation detector or photosensitive semiconductor 82, hereinafter referred to as a photocell. If the light emitted by diode 80 during the positive half-cycle and reflected from the surface of the refrigerant stream 74 is at a maximum, then the resistance of photocell 82 is comparatively low. However, the reflected light diminishes because of formation of bubbles of non-condensed refrigerant in response to a low level or a low pressure/temperature of the refrigerant in the liquid line 72.

The variation in reflected energy received by photocell 82 causes a corresponding variation at the base of transistor 94. Thus, as the reflected light diminishes during a positive half-cycle, the resistance of photocell 82 rises, and the voltage across photocell 82 and at the base of transistor 94 rises to turn transistor 94 "on", resulting in a drop in the voltage level at terminal 95.

A capacitor 96 connected across the collector-emitter circuit of transistor 94 at terminal 95, levels the pulse output at the collector of transistor 94 to provide a voltage which fluctuates in proportion to the change in reflected light detected by photocell 82. This fluctuating voltage is proportional to the amount of bubble formation in the sight glass 70 and may be taken from terminal 95 as a proportional analog output signal to control the operation of the refrigerant circulating loop, e.g. control of condenser fan speed as discussed in detail hereinafter.

The proportional fluctuating voltage from terminal 95 is applied to the base of transistor 98. An adjustable resistance 100 at the base of transistor 94 is preset to determine the output at the collector of transistor 94, so that there is an output at terminal 95 when there is a predetermined amount of bubble formation.

As the fluctuating voltage at the base of transistor 98 increases in response to an increase in bubble formation, the collector current of transistor 98 also increases proportionally. When the collector current from the 12 vdc supply, connected through input pins 1, 2 of optoisolator 104 to the emitter of transistor 98, exceeds the threshold level of the input light emitting semiconductor connected to pins 1,2, the output semiconductor connected to pins 4,6 conducts. This provides a 24 vac digital type output signal for activating alarms or controlling operation of the refrigerant circulating loop.

During the negative half-cycle of the 24 vac supply from terminal 91, there is no positive half-cycle at terminal 90. Therefore, diode 79 does not conduct and there is no radiation emitted from diode 80. Further, transistor 92 is biased "off" and there is no output from the pulse shaping circuit, and no output therefrom to be applied across and controlled by photocell 82. Therefore, photocell 82 is effectively blinded during the negative half-cycle and cannot react, even if spurious light is received from other sources.

Referring now to FIG. 7, there is schematically illustrated a circuit for providing both digital and analog signals representative of the moisture content of refrigerant in the sight glass 70.

During the negative half-cycle of the 24 vac supply at terminal 91, a source diode 105 is forward biased. Current flow is limited by a resistor, but the light emitting diode 86 conducts to radiate light toward the moisture indicator element 84 (positioned in the sight glass 70 as shown in FIG. 5).

A pulse shaping circuit includes a transistor 110. The 24 vac source is connected to ground through a steering diode 106, with the base of transistor 110 being connected between the source and the steering diode 106. During the negative half-cycle of the source voltage, diode 106 is forward biased to clamp the base of transistor 110 at a very small voltage to keep the transistor 110 turned "off" and the voltage at the collector of transistor 110 rises to a value close to the 12 vdc supply.

During the positive half-cycle of the 24 vac source voltage, the steering diode 106 prevents current from flowing through resistor 107, causing the base voltage of transistor 110 to rise to a positive value, turning transistor 110 "on". The voltage at the collector of transistor 110 then drops to near zero. Thus, during the negative half-cycle of the 24 vac source voltage, the pulse shaping transistor 110 provides a half-cycle, positive square wave voltage pulse from the 12 vdc supply across and controlled by the photocell 88.

If a Sporlan model moisture indicator is used, the indicator element 84 is dark green when the moisture content of the refrigerant is low or acceptable, chartreuse when the moisture is in the "caution" range, and yellow when the moisture content is at an unacceptable range. There will be very little light reflected by the moisture indicator 84 when the color is dark green, more light reflected when the color is chartreuse, and still more light reflected when the color is yellow.

Thus, when the color is dark green there is little light detected by photocell 88 and the resistance of the photocell is relatively high. This applies a relatively high base voltage to the transistor 114. This causes transistor 114 to conduct and the voltage at the collector is relatively low. However, as the color changes to chartreuse and yellow, more light is reflected and the resistance of the photocell 88 drops accordingly. As the photocell resistance drops, the voltage at the base of transistor 114 decreases, and the collector-emitter current decreases. Therefore, the collector voltage at terminal 122 increases.

A capacitor 116, connected across the collector-emitter circuit of transistor 114 at terminal 122, levels the pulse output at terminal 122 to provide a voltage which fluctuates in proportion to the change in reflected light detected by photocell 88. This voltage is proportional to the amount of moisture in the refrigerant, and may be taken from terminal 122 as a proportional analog output signal for control purposes. For example, a voltage level in the "caution" range could warn an operator to take steps to prevent the moisture from rising to an unacceptable level.

An adjustable resistance 112 at the base of transistor 114 is preset to determine the output at the collector of the transistor 114, so that there is an output at terminal 122 when there has been a pre-determined amount of color change of indicator element 84.

The fluctuating voltage at terminal 122 is fed to the base of a transistor 118. When the base voltage is low, the collector current of transistor 118 is low and does not exceed the threshold level of the input light emitting diode connected to pins 1,2 of an optoisolator 120. However, when the indicator element 84 is yellow, the voltage at terminal 122 is high resulting in a high collector current of transistor 118. The threshold level at the input pins 1,2 is exceeded and the output semiconductor connected to pins 4,6 of optoisolator conducts. This provides a 24 vac digital type output signal for activating alarms, etc.

During the positive half-cycle of the 24 vac supply at terminal 90, there is no negative half-cycle at terminal 91. Therefore, diode 105 does not conduct and there is no radiation emitted from diode 86. Further, transistor 110 is biased "on" and there is no output from the pulse shaping circuit to be applied across and controlled by photocell 88. Therefore, photocell 88 is effectively blinded during the positive half-cycle and cannot react, even if spurious light is received from other sources.

Figure 8:
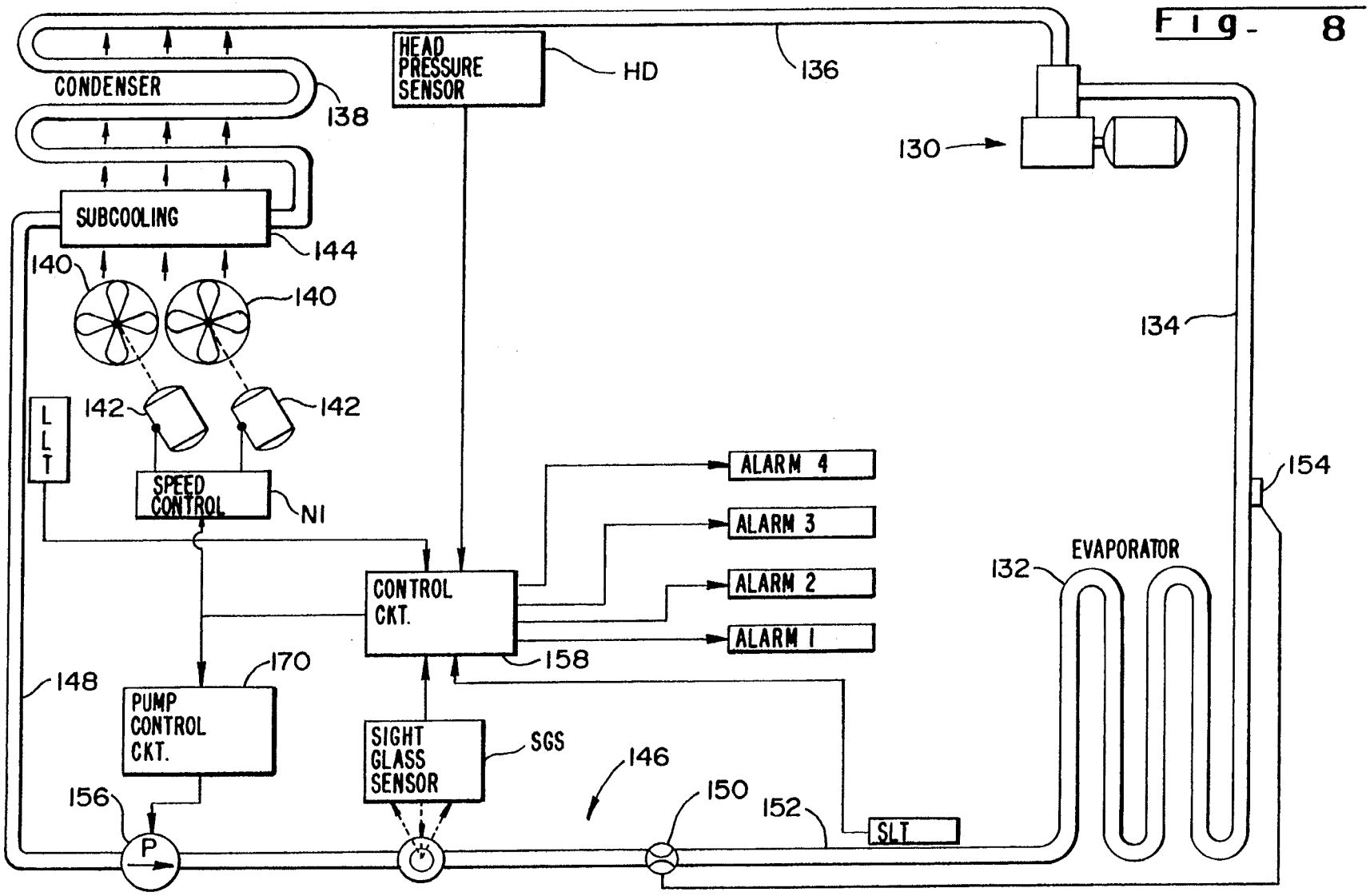
FIG. 8 is a diagrammatic layout of a heat transfer system embodying the teachings of this invention.

Referring now to FIG. 8, there is illustrated in diagrammatic form a heat transfer system embodying the teachings of this invention. A compressor is indicated at 130 for compressing a gaseous heat transfer fluid (commonly called a refrigerant) as the gas is received from an evaporator 132, through suction line 134, which absorbs heat from the surrounding area. The compressed gas then proceeds under pressure via conduit 136 to a condenser 138 where it is condensed to a liquid by a cooling fluid being moved past and in heat exchange relationship with the condenser 138. The cooling fluid may be water or other fluid which can absorb and remove heat from the condenser and refrigerant therein. In this instance, the cooling fluid is air being moved by condenser fans 140 which are driven by motors 142.

As noted hereinbefore, maximum efficiency for the system can be obtained by subcooling the heat transfer fluid to a temperature below the condensing temperature. Accordingly, a subcooling device 144 is illustrated in series with the condenser 138. The device 144 can actually be a part of condenser 138 or a separate component In either case, the subcooling device 144 is located in heat exchange relationship with the stream of cooling fluid from fan 140.

The condensed heat transfer fluid then travels through a liquid line generally designated at 146 back to the evaporator 132. The liquid line is divided into two portions. A first portion 148 connects the condenser 138 and an expansion valve 150. A second portion 152 connects the expansion valve 150 to the evaporator 132. The expansion valve 150 functions to meter the amount of liquid refrigerant entering the evaporator 132. If too little liquid enters the evaporator it evaporates too soon and too much of the evaporator surface becomes ineffective. If too much enters, some liquid will not evaporate and will go on through the evaporator and into the suction line 134.

The most common method of properly feeding liquid to the evaporator is a thermostatic expansion valve. A heat sensing bulb 154 senses heat of the refrigerant in suction line 134 and the expansion valve 150 is opened or closed accordingly to meter the refrigerant. The refrigerant changes from a high pressure liquid upstream of valve 150 to a low pressure liquid down-stream. The refrigerant normally remains in liquid form until it enters the evaporator and then changes to a gas as heat is absorbed.

A liquid pump 156 is used in some systems in the liquid line portion 148 between condenser 138 and expansion valve 150. The pump 156 is used to physically increase the pressure of the liquid refrigerant prior to the expansion valve 150, without adding any appreciable amount of heat to the refrigerant. This pressure increase is helpful in reducing or eliminating bubbles of non-condensed refrigerant ahead of the expansion valve, thereby improving the efficiency of the expansion. Use of a liquid pump increases the initial cost of the system and increases the amount of energy used in operating the system but still may be helpful in certain applications where the load may vary by large amounts and/or where there are low ambient outside temperatures.

Figures 9, 12:
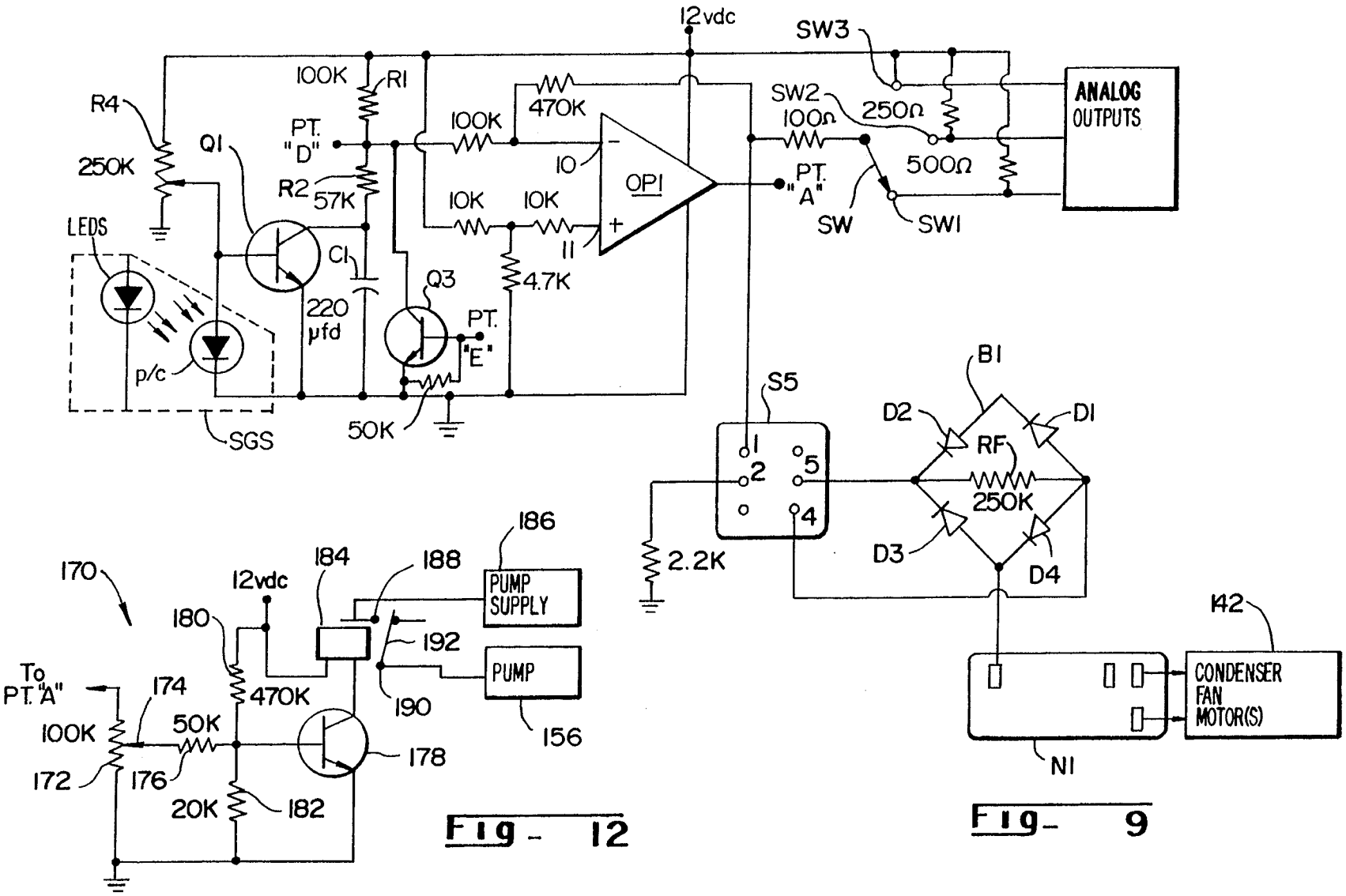
FIGS. 9, 10, 11 and 12 are schematic diagrams of circuits for monitoring and controlling the operation of the system laid out in FIG. 8.
Figure 10:
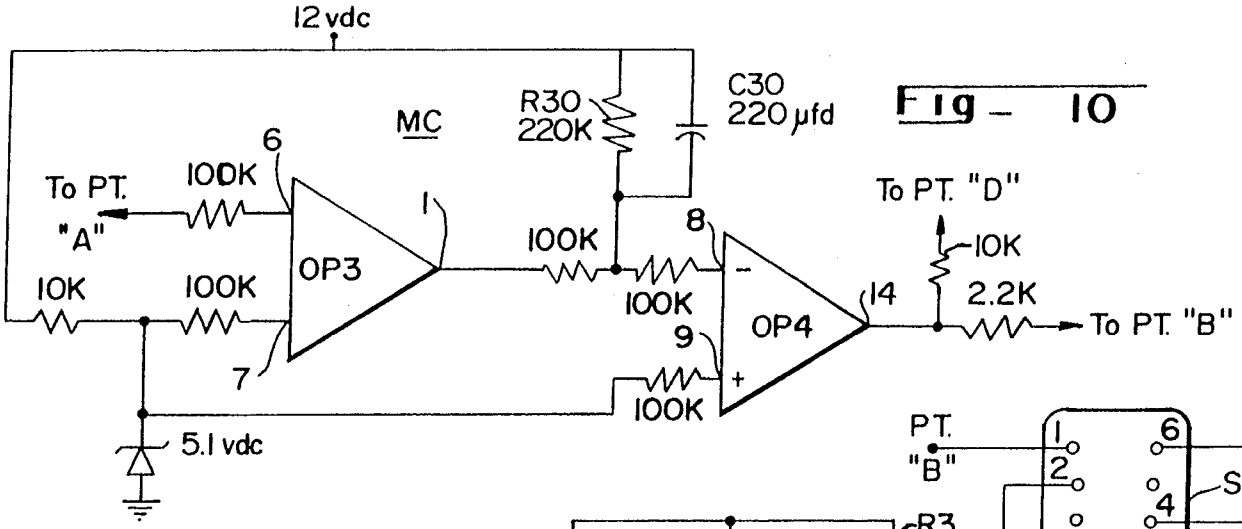
Figure 11:
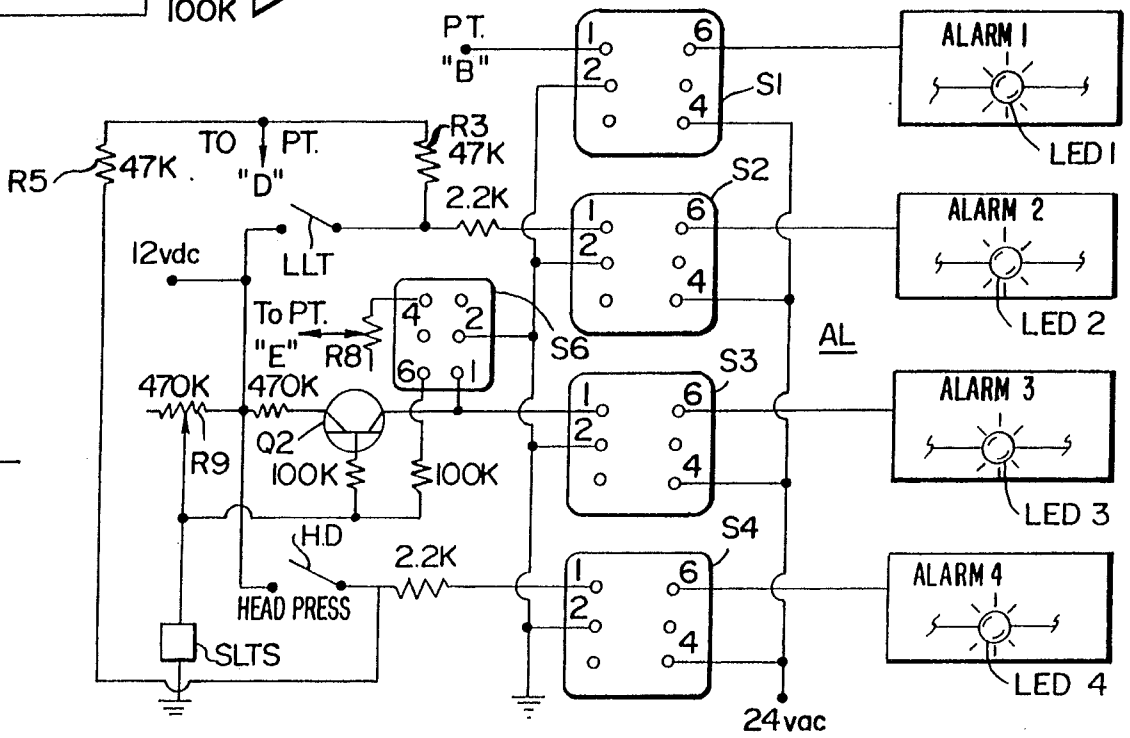

The system illustrated in FIG. 8 is controlled by the circuits shown in FIGS. 9 through 11. The relationships of the various sensing devices used in FIGS. 9 to 11 to the refrigerant loop controlled are shown in FIG. 8.

A sight glass sensor SGS is placed in the liquid line portion 148 between the condenser 138 and the expansion valve 150. If a liquid pump 156 is used, the sight glass sensor SGS is placed between the pump 156 and the valve 150. As will be explained in more detail hereinafter, the sensor SGS monitors the amount of bubbles of non-condensed refrigerant in the liquid line portion 148. The sensor SGS may also monitor moisture content of the refrigerant as described hereinbefore. The output of sensor SGS is connected to control circuit 158, illustrated in FIGS. 9 through 12, which in turn controls the condenser fan motors 142 through speed control.

A liquid line temperature sensor SLT will be called a suction line temperature sensor because it is on the "suction" side of the expansion valve 150 even though it is placed on the liquid line portion 152. Sensor SLT senses the refrigerant temperature after the expansion valve 150 and before entry into the evaporator 132. When that temperature goes below a predetermined set-point (e.g. 34 degrees F.) a signal is sent to the control circuit 158, which again controls fan motors 142 through speed control N1.

A liquid line temperature sensor LLT senses the temperature of the refrigerant in the liquid line portion 148 between the condenser 138 and the expansion valve 150. When that temperature goes above a predetermined set-point, a signal is provided to control circuit 158 to permit the condenser fan speed to be returned to maximum even though other signals may be calling for a slower fan speed. The sensor LLT can also provide an additional signal in response to an excessive temperature to stop system operation until the excess temperature condition is corrected.

A head pressure sensor HD is located between the compressor 130 and the condenser 138 to sense the discharge pressure from the compressor. When that pressure rises above a predetermined set-point, a signal is provided to control circuit 158 to permit condenser fan speed to be returned to maximum, even though other signals are calling for slower fan speed. The sensor HD can also provide an additional signal in response to an excessive head pressure to stop the compressor and prevent it from running until the excessive pressure condition is corrected.

The alarm circuits will be described in greater detail hereinafter. Briefly, Alarm 1 will be activated to indicate that the control circuit 158 has applied all control actions available, yet there are still bubbles of non-condensed refrigerant in the liquid line. Therefore, the operator should check the system for other component or operational problems. Alarm 2 will be activated when the liquid line temperature rises above the predetermined set-point. Alarm 3 will be activated when the suction line temperature goes below the predetermined set-point. Alarm 4 will be activated when the head pressure goes above the predetermined set-point.

Referring now to FIG. 9 the appearance of gas bubbles in the first liquid line portion 148 of the refrigerant circulating loop of FIG. 8, decreases the amount of light from a light emitting diode LEDS, in a sight glass monitor sensor circuit SGS, which is transmitted to a photocell PC from the refrigerant stream. This transmission may be a reflection from the surface of the stream, reflection from a moisture indicating element in the stream, transmission through the stream if the diode LEDS is positioned on the opposite side of the stream, or a combination of these, to a photocell P/C. The resistance of the photocell P/C increases as the received light decreases. The operation of such sensing mechanisms is shown in FIGS. 1 through 7 and described hereinbefore.

A 12 vdc supply is connected through an adjustable resistor R4 to bias the base of a transistor Q1. The base of transistor Q1 is connected to ground through the photocell P/C. As the light from diode LEDS detected by the photocell P/C increases, the resulting increased voltage across the photocell P/C increases the voltage at the base of transistor Q1, causing Q1 to conduct thereby dropping the voltage at the collector of Q1. This also drops the voltage at point "D", which is the junction of resistors R1 and R2.

Point "D" serves as an input for a number of different input signals to be applied to an input pin 10 of an output operational amplifier OP1 of the monitoring circuit in FIG. 9. The first such input signal is the just discussed voltage drop caused by the conduction of Q1. The remaining signals will be discussed hereinafter.

Lowering the voltage at the input pin 10 of amplifier OP1 causes the output of operational amplifier OP1 at point "A" to rise in proportion to the number or amount of gas bubbles (amount of flash) detected. If a moisture indicating element is used in the refrigerant stream, a rise in output of OP1 may also be indicative of a refrigerant moisture content in the refrigerant circulating loop that is too high. Preferably, a separate sight glass is used with a moisture indicating element therein to provide a separate signal for moisture content above, as described hereinbefore.

The output of OP1 at point "A" is connected through pins 1,2 of an optoisolator S5 to ground. As the output of OP1 rises, the amount of light emitted by an input light emitting diode of S5 increases, thereby decreasing the resistance of an output photosensitive component connected across output pins 4,5 of S5. An optoisolator suitable for use as component S5 is model H11D1 manufactured by Motorola.

A motor speed control N1 may be a phase control device such as model PHSA6 of the PHS series for alternating current phase control, manufactured by SSAC, Inc. Such devices control application of input voltage to equipment, in this instance to one or more motors for driving means for moving a cooling fluid past and in heat exchange relationship with a condenser in the refrigerant circulating loop. In this specific embodiment the moving means comprises one or more fans to move cooling air past a condenser and/or means for subcooling condensed liquid refrigerant.

The PHS series device controls fan motor speed, in response to the adjustment of an external resistance, to change the conduction angle of voltage applied to motor terminals. That is, it delays the start of current flow in each half-circle of alternating current. The delay is related to the decrease in the external resistance. In the control circuit of FIG. 9, the external resistance adjustment is obtained by connecting the output of the optoisolator S5 to a modified bridge circuit.

The photosensitive output component of optoisolator S5 has a resistance that decreases in value in response to increasing light from an input light emitter. The modified bridge B1 includes four rectifying diodes D1, D2, D3 and D4 connected so that an alternating current applied to the output of the bridge B1 will have current flow in the same direction on each half-circle through a variable resistance connected across the input of the bridge. The variable resistance includes a large fixed resistance RF (e.g. 250K ohms) in parallel with the variable photosensitive output resistance of the optoisolator S5.

In operation, as the output of amplifier OP1 rises at point "A" in response to the detection of and increase in amount of gas bubbles in the liquid line, the resistance of the output component of optoisolator S5 decreases thereby decreasing the combined parallel resistance at the input of bridge B1. This, in turn, changes the conduction angle of the alternating current supply voltage delivered to the fan motor or motors. The reduction in current conduction causes the fan motor(s) to slow down in a smooth response.

As the fan motors slow down the rate of movement of cooling fluid past the condenser/subcooler slows. The temperature and pressure of the refrigerant in the liquid line will increase to reduce the number of gas bubbles in the liquid line, and to eventually eliminate the gas bubbles if no other adverse conditions exist. This occurs because increasing the pressure on a fluid raises its condensing temperature, and the gas vapor condenses to the fluid form.

As the number of gas bubbles (amount of non-condensed fluid) decreases at the sight glass monitor SGS, the amount of light from LEDS that is detected by the photocell P/C increases. The resulting resistance decrease of photocell P/C lowers the voltage present at the base of transistor Q1, thus reducing the current flow in the collector-emitter circuit. This drop in current flow raises the voltage at the collector of Q1 and thus the voltage at point "D" and at input pin 10 of amplifier OP1. Accordingly, the output of OP1 at point "A" and the input to the optoisolator S5 decrease.

The amount of light received by the output semiconductor component of the optoisolator S5 decreases, and the resistance at the output pines 4,5 and the resistance at the input of the bridge B1 increases. This allows current conduction at an earlier point in each half-cycle of the voltage applied to the condenser fan motor. Fan speed increases, lowering the temperatures and pressure of the refrigerant in the liquid line portion 148 to a maximum efficiency level. Thus, the control circuit operates the system at its maximum efficiency by seeking a balance point by reducing head pressure and increasing subcooling as much as possible without allowing non-condensed refrigerant to exist in the liquid line portion 148.

The rate of fan speed decrease and increase is determined by the charging rate and values of R1, R2 and C1 in the R/C circuit connected to the output emitter-collector circuit of Q1. This R/C circuit acts as a one-way time delay in that, when gas bubbles are detected, response to slow fan speed is almost immediate. However, as gas bubbles disappear there is a delay, which helps prevent hunting by the system and is not as hard on equipment as a system which alternates between full "on" and "off" conditions. This R/C circuit enables a smooth, steady change in the action of the rest of the light detection circuit, and thus a smooth change in the output resistance of the optoisolator S5 and a smooth linear change in condenser fan speed.

An analog output is also provided at point "A", which may be used in control and sensing applications, e.g. computer inputs. A selector switch SW is connected to point "A" through a 100K ohm resistor. The selection of one of the switch output contacts SW1, SW2 or SW3 will provide a 4 to 20 milliamp, zero to 5 volts, or zero to 10 volts output, respectively.

A master control circuit MC is illustrated in FIG. 10. It is provided to detect the variation of the proportional output signal from amplifier OP1 in FIG. 9 at point "A" in excess of a preset limit. The proportional output signal is connected to input pin 6 of an operational amplifier OP3. The operational amplifier OP3 is biased at pin 7 so that when the point "A" signal is below a preset limit, the output at pin 1 of OP3 goes to ground. This allows the RC circuit R30/C30 to discharge.

The output of amplifier OP3 is connected to input pin 8 of an operational amplifier OP4. The amplifier OP4 is biased at pin 9 so that OP4 normally provides a low level state output at pin 14. The OP4 output at pin 14 is connected, through at 2.2K resistor and point "B", to point "B" and pin 1 of optoisolator S1 in FIG. 11. The normal low level output is insufficient to cause enough light emission from an input light emitting diode connected across input pins 1,2 of S1 to cause enough resistance reduction of an output photosensitive semiconductor connected across output pins 4,6 of S1 to permit application of a 24 vac supply voltage to ALARM 1.

When a proportional output signal at point "A" is above the preset limit of amplifier OP3, it may indicate that there are more gas bubbles in the liquid lines than may be taken care of by this control method and apparatus, and that further steps should be taken by an operator or technician. For example, there may be a leak or loss of refrigerant causing gas bubbles in the liquid line. Further, there may be a problem with the expansion valve or other components that must be taken care of by a technician. In addition, if an indicating element is positioned in the refrigerant stream which changes color in response to moisture content of the refrigerant, the color change may affect the light detected by the photocell P/C and cause an out-of-limit signal, either in combination with gas bubble interference with light detection, or alone.

Thus, when a proportional output signal at point "A" is above the preset limit of the comparator amplifier OP3, the output at pin 1 of OP3 rises from ground level and allows the B30/C30 circuit to start charging. The values of R30 and C30 are selected to provide a desired charging time, so that R30/C30 acts as a time delay before the input to pin 8 of amplifier OP4 rises above the bias at pin 9. After the time delay, the output of OP4 at pin 14 rises from the normally low level state output to a high level state. This charge time is used to prevent "hunting" in response to short term or transient excursions of the proportional output signal at point "A" above the preset limit.

When the output of amplifier OP4 rises to a high level state, the voltage at point "B", in the alarm circuit in FIG. 11 also rises. Current flow between pins 1,2 of optoisolator S1, causes sufficient light emission from the input light emitting diode to cause the resistance of the output photosensitive semiconductor to drop to enable a 24 vac supply to activate ALARM 1 and the illumination of associated LED1. These alarm indicators signal a technician that his services are needed to correct the problems discussed above that may be causing a proportional output from amplifier OP1 at point "A" that is above the preset limits of the comparator amplifier OP3.

The master control MC output from OP4 is also connected to point "D" in the sight glass monitor circuit in FIG. 9. When the preset limit is exceeded, the high level state voltage is thus applied to the input pin 10 of amplifier OP1, which decrease the output of OP1, and turns the optoisolator S5 "off". In response to the "off" condition of S5, the speed control N1 returns the condenser fan motors to full speed.

As the sight glass monitoring circuit and condenser fan motor control in FIG. 9 attempts to reduce the head pressure and the temperature of the refrigerant in the liquid line portion 148, the capacity of system components increase. These components sometimes increase and decrease in capacity to a point where they will be out of balance with the design of the refrigerant circulation loop. For example, as the head pressure decreases, the compressor capacity increases. As the temperature of the liquid refrigerant in the liquid line decreases, the evaporator capacity increases. As the head pressure decreases, the expansion valve capacity decreases. As a result, the evaporator in an air conditioning unit or a chiller barrel on a liquid chilling unit may have a tendency to freeze condensation on the evaporator or a chiller barrel. The air conditioning evaporator coils will ice or frost over and the efficiency drops to almost zero. On a liquid chiller, the vessel may freeze and major damage may occur.

To prevent the freezing and frosting as just described above, a suction line temperature sensor SLTS is placed to measure the temperature of the liquid in the suction line 152 between the expansion valve and the evaporator, as noted in FIG. 8. The suction line temperature sensor SLTS is also illustrated in the alarm circuit AL in FIG. 11. The sensor may be of the thermistor type which is connected to a bias voltage source obtained from an adjustable resistor R9. The value of resistance R9 is adjusted so that when the liquid temperature is above a preselected set-point temperature (e.g. 34° F.) the voltage presented to the base of a transistor Q2 bases Q2 "off" or to a non-conducting state.

As the temperature of the liquid in line portion 152 falls below the set-point of the thermistor sensing device SLTS, the adjusted bias voltage from R9 turns the transistor Q2 "on", permitting conduction in the emitter-collector circuit. As the temperature falls further, the bias signal increases and the emitter-collector circuit resistance falls further.

When the transistor Q2 starts conducting, the 12 vdc supply is connected to input pin 1 of the optoisolator S3, and to input pin 1 of optoisolator S6. The 12 vdc supply turns the optoisolator S3 "on" and allows application of a 24 vac supply to ALARM 3 and to illuminate the associated visual LED 3 alarm to let an operator know what is happening.

The 12 vdc connected to pin 1 of optoisolator S6 turns S6 "on". This allows the bias voltage controlled by the sensor SLTS which is connected to output pin 6 of S6 to be applied to an adjustable resistor RS. The voltage drop across resistor R8 is connected to point "E" in FIG. 9, which is at the base of a transistor Q3. The collector of Q3 is connected to point "D" in FIG. 9, which provides multiple inputs to the amplifier OP1 as noted hereinbefore. The emitter of Q3 is connected to ground.

The bias voltage connected to pin 6 of optoisolator S6 increases in proportion to the drop below the set-point of the temperature of the liquid in the liquid line 152 after the expansion valve. This causes a corresponding increase in the voltage across resistor R8, and thus the voltage to point "E" and the base of transistor Q3. As the R8 voltage is applied to the base of Q3 it causes Q3 to conduct to start to connect point "D" to ground, dropping the voltage at the collector of Q3 and at point "D" and the input of amplifier OP1. Lowering the voltage at the input of OP1 causes the output of OP1 to rise. This initiates the sequence of slowing the fan speed via the optoisolator S5 and motor control N1 in proportion to the magnitude of the input to the base of transistor Q3 as described hereinbefore.

As the speed of the condenser fans slows, the rate of movement of cooling fluid past the condenser and subcooler slows. The temperature and pressure of the refrigerant in the condenser and subcooler increase, thus increasing head pressure and liquid temperature in the liquid line. The increase in liquid temperature as it passes through the expansion valve reduces the temperature difference between the refrigerant and the ambient temperature surrounding the evaporator coil, reducing the rate of evaporation of refrigerant in the coil and the capacity of the coil. The increased temperature of the refrigerant in the evaporator coil will decrease the chances that there will be formation of frost or ice on the coil or that the chiller vessel will freeze. This improves the efficiency of the system, because it prevents frost or ice formation which would eventually reduce system efficiency to zero.

As the liquid temperature in the liquid line after the expansion valve returns to a temperature above the set-point of the suction line temperature sensor SLTS, the bias voltage applied to the base of transistor Q2 falls and turns Q2 "off" when the set-point is reached. When Q2 stops conducting the voltage for activating ALARM 3 is turned "off" and the signal from optoisolator S6 is removed from point "E". This allows the speed control N1 to return the fans to full speed.

The set-point is preferably set far enough above the freezing temperature of any condensate on the evaporator or moisture in the air around the evaporator (e.g. 34° F.), so that slowing of the condenser fans will prevent even the initial formation of frost or ice and thus avoid any associated reduction in efficiency of the system. Even so, ALARM 3 and the associated visual alarm LED 3 are turned "on" to alert the operator that frost or ice formation might be imminent. If the fan slowing does not bring the suction line temperature back above the set-point within a reasonable time, the operator can take further corrective steps.

When the condenser fans are being slowed to overcome either the problem of gas bubbles in the liquid line or to prevent the formation of frost or ice on the evaporator, it is important to monitor the temperature of the liquid in the liquid line between the condenser and the expansion valve and to monitor the head pressure. Excessively high liquid line temperature (and pressure) and/or head pressure can cause a problem because of the physical limitations of the components. While this is true any time, this invention raises the liquid temperature and head pressure to correct the gas bubble and frost/ice formation problems, so the monitoring becomes even more important.

The liquid line temperature sensor LLT in FIG. 8 senses the temperature of the liquid refrigerant in the liquid line between the condenser and the expansion valve. When the liquid temperature exceeds a preselected limit, contacts LLT close in the alarm circuit AL in FIG. 11. This connects a 12 vdc supply to input pins 1,2 of optoisolator S2 to turn it "on" to connect a 24 vac supply to the ALARM 2 circuit and the associated visual alarm LED 2. This alerts the operator that the liquid line temperature has exceeded the pre-set limit.

Similarly, in FIG. 8, a maximum head pressure sensor HD senses the head pressure between the compressor and the condenser. When sensor HD detects a head pressure that exceeds a pre-set limit, HD contacts close in the alarm circuit in FIG. 11. This connects the 12 vdc supply to input pins 1,2 of optoisolator S4 to turn it "on" to connect the 24 vac supply to the ALARM 4 circuit and the associated visual alarm LED 4. Again, this alerts the operator that the pre-set maximum head pressure had been exceeded.

When either of the LLT or HD contacts close in FIG. 11, the 12 vdc supply applied to input pins 1,2 of optoisolators S2 or S4 generates a voltage across the 2.2K resistors between the LLT or HD contact and ground. This provides a signal voltage via resistors R3 or R5 for point "D" in FIG. 11, which is connected to point "D" in FIG. 9. As noted hereinbefore, a signal voltage at point "D" is applied to input pin 10 of the operational amplifier OP1. As a result the output of amplifier OP1 falls, raising the resistance of the output component of optoisolator S5 to return the condenser fan speed to 100 percent via speed control N1. This moves more cooling air past the condenser and subcooler to cool and lower the temperature of the refrigerant in the condenser and the liquid line, and to reduce the head pressure. When the liquid temperature and/or the head pressure fall below the pre-set limits, the LLT and HD contacts open and the system returns to the normal control described hereinbefore.

Optoisolators S1 to S4 and S6 may be Motorola model H11J1, with a triac type output component so that an alternating current can be controlled.

Referring now to FIG. 12, there is shown a detailed schematic of a liquid line pump control circuit, which is indicated generally at 170 in both FIGS. 8 and 12, to control operation of the pump 156 shown in the refrigerant circulating loop in FIG. 8.

Point "A" in FIG. 9, is connected to ground through an adjustable resistor 172. The adjustable contact 174 is connected through a resistor 176 to the base of a transistor 178. The base is also connected to the junction of bias resistors 180 and 182 which are, in turn, connected between a 12 vdc supply and ground.

The 12 vdc supply is also connected through an energizing coil of a relay 184 and the collector-emitter circuit of transistor 178 to ground. A pump supply voltage 186 is connected to one terminal 188, and the other terminal 190 of the relay 184 is connected to the liquid line pump 156.

In operation the adjustable resistor 172 is preset so that the transistor 178 is biased "off" until the output of operational amplifier OP1 at point "A" in FIG. 9 rises to a predetermined value. This permits selection of the time of operation of the liquid line pump, and also prevents premature operation of the pump in response to transient or short time increases in OP1 output which are relatively low values.

When the output from OP1 at point "A" rises to a predetermined value, indicating a selected level of bubble formation of non-condensed refrigerant in the liquid line, the transistor 178 is turned "on". Current then flows through the energizing coil to relay 184 and the collector-emitter circuit of transistor 178 to ground. Contacts 192 close, connecting the pump supply voltage terminal 188 to the pump terminal 190 and starting pump 156. This will increase the pressure of the refrigerant in liquid line 148 between the pump 156 and the expansion valve 150 to increase condensation of the refrigerant and remove bubbles to increase efficiency.

When the level of bubble formation in the liquid line drops below the above-noted preselected level, the point "A" signal falls below the value preset by the adjustable resistor 172, and transistor 178 is turned "off". Current flow in the energizing coil of relay 184 stops and contacts 192 open, disconnecting the pump supply voltage from the liquid line pump.

As noted hereinbefore, the use of a liquid pump in the refrigerant circulating loop is optional. Such a pump is most helpful in certain applications where the load may vary by large amounts.

While the choice of the specific components and their arrangement in the preferred embodiments described herein illustrate the results and advantages over the prior art, the invention is not limited to those specific components and their arrangement. Thus, the forms of the invention shown herein and described are to be taken as illustrative only, and changes in the components or their arrangement may be made without departing from the spirit and scope of this invention. There has been disclosed method and apparatus which differs from, provides functions not performed by, and has clear advantages over the prior art.

We claim:

1. Apparatus for remotely monitoring the condition of a heat transfer fluid stream in a conduit of a heat transfer system, comprising;

(a) a radiation source, (b) means for detecting radiation, (c) an indicating element adapted to change color when the moisture content of the heat transfer fluid changes, said indicating element being located so that the amount of radiation detected by said radiation detection means is altered in response to a change in color of said indicating element, (d) means for positioning said radiation source so that radiation therefrom impinges a fluid stream in a conduit, (e) means for positioning said radiation detecting means to detect radiation after impingement with the fluid stream, (f) means responsive to said radiation detecting means for generating a signal which is proportional to the amount of radiation detected, and (g) means responsive to said signal for indicating the condition of said fluid stream.

2. Apparatus as defined in claim 1 in which (a) said radiation source positioning means directs radiation at a heat transfer fluid stream so that when bubbles of non-condensed fluid form in the fluid stream the bubbles alter the amount of radiation detected by said radiation means, and which further includes (b) means responsive to said radiation detecting means for generating a first signal indicating color change and moisture content, and for generating a second signal indicating non-condensed fluid content, in said fluid stream.

3. Heat transfer apparatus, comprising;

(a) a heat transfer fluid circulating loop including means for evaporating a heat transfer fluid, means for condensing heat transfer fluid received from said evaporating means, liquid line means for conducting heat transfer fluid from said condensing means to said evaporating means, and suction line means for conducting heat transfer fluid from said evaporating means to said condensing means, (b) means for monitoring a condition of a heat transfer fluid in said liquid line including a radiation source for directing radiation to impinge a heat transfer fluid in said liquid line, means for detecting radiation from said radiation source after impingement with a heat transfer fluid, and means responsive to the amount of radiation detected for indicating the condition of an impinged heat transfer fluid, and (c) an indicating element adapted to change color when the moisture content of a heat transfer fluid changes, said indicating element being located so that the amount of radiation detected by said radiation detection means is altered in response to a change in color of said indicating element.

4. Heat transfer apparatus as defined in claim 3 which further includes means responsive to the amount of radiation detected for indicating that a moisture problem should be addressed.

5. Heat transfer apparatus, comprising;

(a) a heat transfer fluid circulating loop including means for evaporating a heat transfer fluid, means for condensing heat transfer fluid received from said evaporating means, liquid line means for conducting heat transfer fluid from said condensing means to said evaporating meads, suction line means for conducting heat transfer fluid from said evaporating means to said condensing means, and means for controlling operation of at least one circulating loop component, (b) means for monitoring a condition of a heat transfer fluid in said liquid line including a radiation source for directing radiation to impinge a heat transfer fluid in said liquid line, means for detecting radiation from said radiation source after impingement with a heat transfer fluid, and means responsive to the amount of radiation detected for indicating the condition of an impinged heat transfer fluid, the formation of bubbles of non-condensed fluid in an impinged heat exchange fluid stream altering the amount of radiation detected by said radiation detection means, and (c) means responsive to the amount of radiation detected for generating a detection signal which is proportional to the amount of non-condensed heat exchange fluid in a heat exchange fluid stream in said liquid line, and (d) means responsive to said proportional signal for varying said operation controlling means to change operation of s circulating loop component in an smooth continuous manner.

6. Apparatus as defined in claim 5 which includes circulating loop component means for moving a cooling fluid past and in heat exchange relationship with said condensing means to remove heat from a heat exchange fluid in said condensing means, and which further includes means responsive to said proportional detection signal for proportionally varying the rate at which said cooling fluid moving means moves said cooling fluid past said condensing means to maintain heat exchange fluid in said liquid line at the lowest temperature possible without formation of non-condensed heat exchange fluid in said liquid line.

7. Apparatus as defined in claim 6 in which said cooling fluid rate varying means is responsive to said proportional detection signal to decrease proportionally the rate of movement of said cooling fluid in response to the detection of an increasing amount of non-condensed heat exchange fluid in said liquid line.

8. Apparatus as defined in claim 6 which further includes means for comparing said detection signal to a predetermined upper limit level, and means responsive to said upper limit comparing means for terminating operation of said cooling fluid rate varying means and for setting said cooling fluid moving means to move said cooling fluid at a predetermined rate when said upper limit is exceeded.

9. Apparatus as defined in claim 8 which further includes time delay means for delaying termination of operation of said cooling fluid rate varying means for a predetermined period to prevent hunting by the system.

10. Apparatus as defined in claim 8 which further includes alarm means responsive to said upper limit comparing means for indicating that the system needs operator attention when said upper limit is exceeded.

11. Apparatus as defined in claim 5 which further includes means for subcooling a heat transfer fluid after condensation of the heat transfer fluid in said condensing means, said subcooling means being disposed in heat exchange relationship with said cooling fluid being moved by said cooling fluid moving means.

12. Heat transfer apparatus as defined in claim 5 which further includes means for moving a cooling fluid past and in heat exchange relationship with said condensing means, and control means for said cooling fluid moving means which is responsive to a decrease in said proportional detection signal to proportionally increase the rate of movement of said cooling fluid.

13. Heat transfer apparatus as defined in claim 12 in which said cooling fluid control means is responsive to an increase in said proportional detection signal to proportionally decrease the rate of movement of said cooling fluid.

14. Heat transfer apparatus, comprising;

(a) a heat transfer fluid circulating loop including means for evaporating a heat transfer fluid, means for condensing heat transfer fluid received from said evaporating means, liquid line means for conducting heat transfer fluid from said condensing means to said evaporating means, and suction line means for conducting heat transfer fluid from said evaporating means to said condensing means, (b) means for monitoring a condition of a heat transfer fluid in said liquid line including a radiation source for directing radiation to impinge a heat transfer fluid in said liquid line, means for detecting radiation from said radiation source after impingement with a heat transfer fluid, and means responsive to the amount of radiation detected for indicating the condition of an impinged heat transfer fluid, the formation of bubble of non-condensed fluid in an impinged heat exchange fluid stream altering the amount of radiation detected by said radiation detection means, (c) means responsive to the amount of radiation detected for generating a detection signal which is proportional to the amount of non-condensed heat exchange fluid in a heat exchange fluid stream in said liquid line, (d) means for moving a cooling fluid past and in heat exchange relationship with said condensing means to remove heat from a heat exchange fluid in said condensing means, (e) means responsive to said detection signal for varying the rate at which said cooling fluid moving means moves said cooling fluid past said condensing means to maintain heat exchange fluid in said liquid line at the lowest temperature possible without formation of non-condensed heat exchange fluid in said liquid line;

(f) means for sensing the temperature of a heat exchange fluid in said liquid line and providing a signal when said fluid exceeds a predetermined temperature, and (g) means responsive to said liquid line excessive temperature signal for terminating operation of said cooling fluid rate varying means and for setting said cooling fluid moving means to move said cooling fluid at a predetermined rate.

15. Apparatus as defined in claim 14 which further includes alarm means responsive to said excessive liquid line temperature signal for indicating that the system needs operator attention.

16. Heat transfer apparatus, comprising;

(a) a heat transfer fluid circulating loop including means for evaporating a heat transfer fluid, means for condensing heat transfer fluid received from said evaporating means, liquid line means for conducting heat transfer fluid from said condensing means to said evaporating means, and suction line means for conducting heat transfer fluid from said evaporating means to said condensing means, (b) means for monitoring a condition of a heat transfer fluid in said liquid line including a radiation source for directing radiation to impinge a heat transfer fluid in said liquid line, means for detecting radiation from said radiation source after impingement with a heat transfer fluid, and means responsive to the amount of radiation detected for indicating the condition of an impinged heat transfer fluid, the formation of bubbles of non-condensed fluid in an impinged heat exchange fluid stream altering the amount of radiation detected by said radiation detection means, (c) means responsive to the amount of radiation detected for generating a detection signal which is proportional to the amount of non-condensed heat exchange fluid in a heat exchange fluid stream in said liquid line, (d) means for moving a cooling fluid past and in heat exchange relationship with said condensing means to remove heat from a heat exchange fluid in said condensing means, (e) means responsive to said detection signal for varying the rate at which said cooling fluid moving means moves said cooling fluid past said condensing means to maintain heat exchange fluid in said liquid line at the lowest temperature possible without formation of non-condensed heat exchange fluid in said liquid line, (f) means for sensing the temperature of a heat exchange fluid in said suction line and providing a signal when the fluid goes below a predetermined temperature, and (g) means responsive to said suction line low temperature signal for terminating operation of said cooling fluid rate varying means and for setting said cooling fluid moving means to move said cooling fluid at a predetermined rate.

17. Apparatus as defined in claim 16 which further includes alarm means responsive to said suction line low temperature for indicating that the system needs operator attention.

18. Heat transfer apparatus, comprising;

(a) a heat transfer fluid circulating loop including means for evaporating a heat transfer fluid, means for condensing heat transfer fluid received from said evaporating means, liquid line means for conducting heat transfer fluid from said condensing means to said evaporating means, and suction line means for conducting heat transfer fluid from said evaporating means to said condensing means, (b) means for monitoring a condition of a heat transfer fluid in said liquid line including a radiation source for directing radiation to impinge a heat transfer fluid in said liquid line, means for detecting radiation from said radiation source after impingement with a heat transfer fluid, and means responsive to the amount of radiation detected for indicating the condition of an impinged heat transfer fluid, the formation of bubbles of non-condensed fluid in an impinged heat exchange fluid stream altering the amount of radiation detected by said radiation detection means, (c) means responsive to the amount of radiation detected for generating a detection signal which is proportional to the amount of non-condensed heat exchange fluid in a heat exchange fluid stream in said liquid line, (d) means for moving a cooling fluid past and in heat exchange relationship with said condensing means to remove heat from a heat exchange fluid in said condensing means, (e) means responsive to said detection signal for varying the rate at which said cooling fluid moving means moves said cooling fluid past said condensing means to maintain heat exchange fluid in said liquid line at the lowest temperature possible without formation of non-condensed heat exchange fluid in said liquid line, (f) means for sensing the pressure of a heat exchange fluid prior to entry of a fluid into said condensing means and providing a signal when the pressure of the fluid goes above a predetermined pressure, and (g) means responsive to said excessive pressure signal for terminating operation of said cooling liquid rate varying means and for setting said cooling fluid moving means to move said cooling fluid at a predetermined rate.

19. Apparatus as defined in claim 18 which further includes alarm means responsive to said excessive pressure signal for indicating that the system needs operator attention.

20. A method for controlling a heat transfer system by monitoring the condition of a heat transfer fluid in a liquid line between means for condensing said transfer fluid and means for evaporating said fluid, comprising the steps of;

(a) positioning a radiation source whereby radiation therefrom impinges a heat transfer fluid in a liquid line of a heat transfer system, (b) positioning a radiation detector to detect radiation after impingement with said transfer fluid, (c) locating an indicating element in said transfer fluid which changes color in response to a change in moisture content in said transfer fluid, whereby the amount of radiation detected by said radiation detector is altered in response to color changes of said indicating element, and (d) measuring the amount of radiation detected to determine the condition of said transfer fluid.

21. A method for controlling a heat transfer system by monitoring the condition of a heat transfer fluid in a liquid line between means for condensing said transfer fluid and means for evaporating said fluid, comprising the steps of:

(a) positioning a radiation source whereby radiation therefrom impinges a heat transfer fluid in a liquid line of a heat transfer system:

(b) positioning a radiation detector to detect radiation after impingement with said transfer fluid, formation of bubbles of non-condensed heat transfer fluid in said liquid line altering the amount of radiation received by said radiation detector, (c) measuring the amount of radiation detected to determine the condition of said transfer fluid, (d) generating a detection signal which is proportional to the amount of radiation detected and thus to the amount of bubble formation in said liquid line, and (e) proportionally varying operation of at least one heat transfer system component to reduce bubble formation.

22. A method as defined in claim 21 which further includes the steps of:

(a) moving a cooling fluid past and in heat exchange relationship with said condensing means, and (b) varying the rate of movement of said cooling fluid in response to said detection signal so that the temperature of said heat transfer fluid in said liquid line is kept as low as possible without formation of bubbles of non-condensed transfer fluid in said liquid line.

23. A method for determining the presence of a contaminant in a fluid stream, comprising the steps of:

(a) exposing a sensing surface to a fluid stream, said sensing surface changing color in response to a contaminant in said fluid stream, (b) positioning a radiation source whereby radiation therefrom impinges said sensing surface, (c) positioning a radiation detector to detect radiation after impingement with said sensing surface, and (d) measuring the amount of radiation detected to determine the presence of a contaminant as the amount of radiation detected is altered in response to color changes of said sensing surface.

24. A method as defined in claim 23 in which said fluid stream is a heat transfer fluid in a line of a heat transfer system, and which further includes the step of providing a warning signal when the amount of radiation detected exceeds a predetermined change indicating an undesirable level of contaminant in said fluid stream.

25. Apparatus for remotely monitoring the condition of a heat transfer fluid stream in a conduit of a heat transfer system and controlling operation accordingly, comprising;

(a) A radiation source, (b) means for detecting radiation, (c) means for positioning said radiation source so that radiation therefrom impinges a heat transfer fluid stream in a conduit, (d) means for positioning said radiation detecting means to detect radiation after impingement with the fluid stream, the formation of bubbles of non-condensed fluid in an impinged stream altering the amount of radiation detected by said radiation detection means, (e) means for generating a detection signal which is proportional to the amount of non-condensed heat transfer fluid in said fluid stream in said conduit, and (f) means responsive to said proportional signal for proportionally altering operation of the heat transfer system.

* * * * *